United States Patent [19]

Sessions

[11] 4,041,912

[45] Aug. 16, 1977

[54] SOLID-STATE IGNITION SYSTEM AND METHOD FOR LINEARLY REGULATING AND DWELL TIME THEREOF

[75] Inventor: Douglas Charles Sessions, Tempe, Ariz.

[73] Assignee: Motorola, Inc., Schaumburg, Ill.

[21] Appl. No.: 607,402

[22] Filed: Aug. 25, 1975

[51] Int. Cl.[2] ..... F02P 1/00

[52] U.S. Cl. ..... 123/117 R; 123/148 E

[58] Field of Search ..... 123/117 R, 146.5 A, 123/148 E

[56] References Cited

U.S. PATENT DOCUMENTS

| | | | |
|---|---|---|---|
| 3,867,916 | 2/1975 | Bigalke | 123/117 R |
| 3,885,534 | 5/1975 | Webster | 123/148 E |
| 3,888,220 | 6/1975 | Bigalke et al. | 123/117 R |
| 3,890,944 | 6/1975 | Wernn et al. | 123/146.5 A |
| 3,916,855 | 11/1975 | Fauser et al. | 123/148 E |
| 3,923,029 | 12/1975 | Polo | 123/148 E |
| 3,937,193 | 2/1976 | Kim | 123/117 R |
| 3,938,490 | 2/1976 | Snyder et al. | 123/148 E |
| 3,943,896 | 3/1976 | Green et al. | 123/148 E |
| 3,989,024 | 11/1976 | Lai et al. | 123/148 E |

FOREIGN PATENT DOCUMENTS

| | | | |
|---|---|---|---|
| 2,456,580 | 6/1975 | Germany | 123/148 E |

*Primary Examiner*—Carroll B. Dority, Jr.
*Assistant Examiner*—Paul Devinsky
*Attorney, Agent, or Firm*—Michael D. Bingham

[57] ABSTRACT

An electronic, solid-state ignition system for an internal combustion engine is disclosed which is responsive to alternating timing signals produced in timed relationship with the engine cycling. The electronic system comprises a plurality of integrator circuits, a transistorized output stage and a feedback loop for linearly regulating the current limit duty cycle to be a fixed percent of the firing cycle time period independent of current ramp time through the coil. As a result, sufficient spark potential is developed and predetermined spark timing is produced thereby preventing mis-spark even though the engine may be accelerating at a maximum specified rate or decelerating.

7 Claims, 4 Drawing Figures

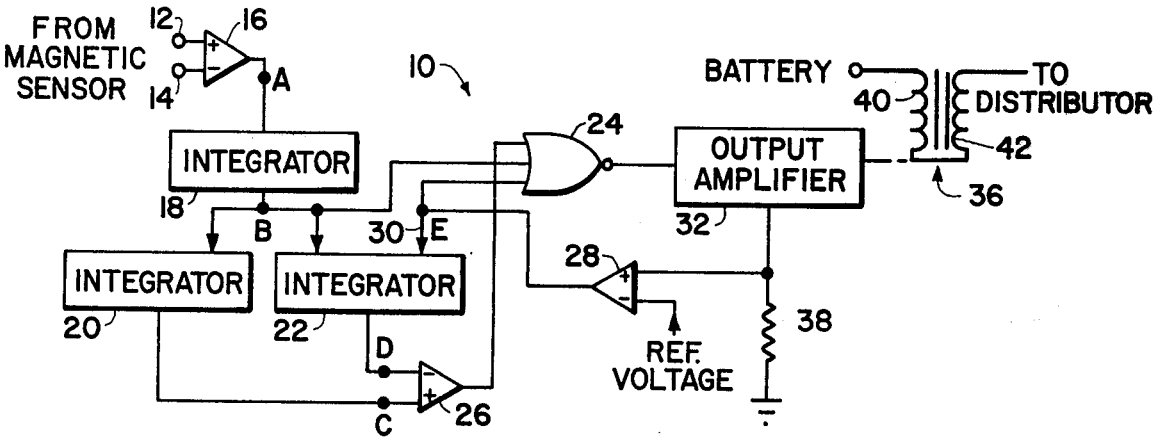
FIG. 1
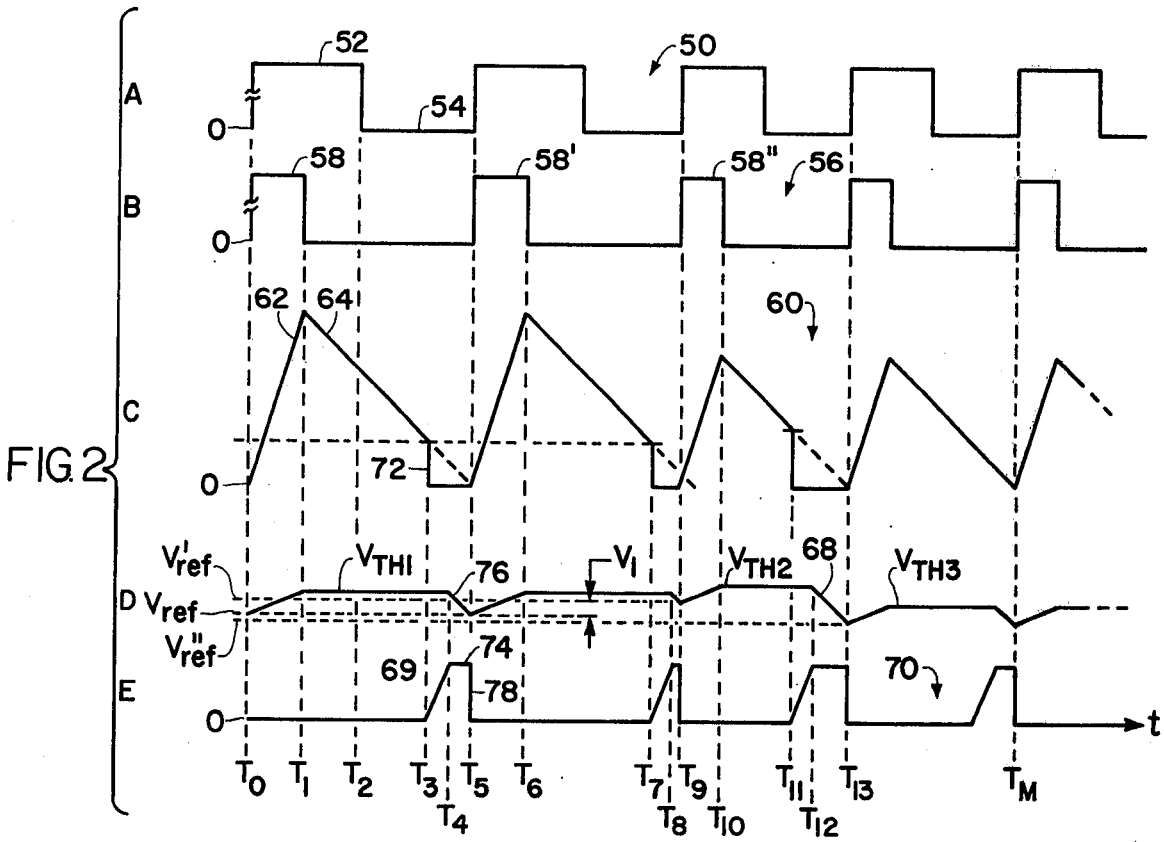

SOLID-STATE IGNITION SYSTEM AND METHOD FOR LINEARLY REGULATING AND DWELL TIME THEREOF

BACKGROUND OF THE INVENTION

This invention relates to internal combustion engine ignition systems and, more particularly, to a solid-state ignition system.

Internal combustion engines which are to be used in "tomorrows" automobiles may be required to operate for an equivalent of 50,000 miles without any significant increase in pollutant emission. It has been recognized that present mechanical ignition systems are inadequate with respect to this requirement and that electronic ignition systems which are completely solid-state are needed. Several forms of solid-state ignition systems have been constructed to replace the conventional mechanical breaker point type of ignition systems now being used. These prior art solid-state ignition systems are mostly concerned with providing adequate sparking potential to operate the internal combustion engine and limiting the energization current produced thereby in order to protect transistorized output stages and the ignition coil.

Furthermore, because many automobiles today employ catalytic converters for reducing pollution emissions, it is important that sufficient spark potential be developed to prevent a no-spark condition from occuring during operation of the engine. If during either constant engine RPM operation or during engine acceleration, a spark does not occur in timed relationship to the engine cycle, raw fuel could be drawn directly into the catalytic converter. Since catalytic converters have high internal temperatures, the raw fuel could be ignited therein which might damage the converter. Therefore, it is of major concern that solid state ignition systems provide sufficient energization current to the primary winding of the ignition coil in correct timed relationship to the operation of the engine to ensure that a spark will be produced to prevent damage to the catalytic converter.

Thus a need exists for a solid-state ignition system which provides a fixed current-limit duty cycle of the energizing current with respect to the total time period of the firing cycle of the internal combustion engine.

SUMMARY OF THE INVENTION

Accordingly, it is an object of the present invention to provide an improved solid-state ignition system for internal combustion engines.

It is another object of the invention to provide a solid-state ignition system which limits the magnitude of energization current flow through the ignition coil to a predetermined value and which provides sufficient spark potential to ensure firing in the engine.

It is still another object of the invention to provide a solid-state ignition system including a linear feedback control loop for regulating the energization current-limiting duty cycle to a substantially fixed percentage of the total time period of the firing cycle of the internal combustion engine.

It is a further object of the invention to provide a solid-state ignition system including a linear feedback control loop for regulating the energization current-limiting duty cycle to a substantially fixed percent of the time period of the firing cycle of the internal combustion engine even though the current charge time through the ignition coil varies.

In accordance with the present invention, a solid-state ignition system and method for regulating the output current-limit duty cycle to a fixed percent of the total time period of the firing cycle of an internal combustion engine are provided wherein enough energization current is provided through an ignition coil primary winding to generate sufficient spark potential. Moreover, the solid-state ignition system employs a linear feedback control loop responsive to generated timing signals crossing a zero reference point for linearly varying a threshold control voltage to either increase or decrease energization current-limiting time through the primary winding of the ignition coil. This maintains the aforementioned current-limit duty cycle to a predetermined, substantially fixed percent of the engine firing cycle time period regardless of variation in the charging ramp time of the energization current through the ignition coil.

The solid state ignition system including an output amplifier stage is rendered conductive and nonconductive in timed relationship to successive generated timing signals for charging and discharging the ignition coil. The output amplifier stage is rendered conductive in response to an applied control signal. A first circuit is provided for producing a reference signal having first and second portions indicative, respectively, of a first time interval of the ignition signals and the remainder of the duration of the ignition signals. A second circuit is operatively coupled to the first circuit for producing a threshold signal. The reference signal and threshold signal are compared by a comparator gating circuit which produces the control signal to render the output amplifier stage conductive when the magnitude of the second portion of the reference signal reaches a predetermined value with respect to the magnitude of the threshold signal. A feedback circuit is operatively coupled to the output amplifier stage and produces a feedback signal for limiting the current through the output amplifier stage and for linearly varying the magnitude of the threshold signal in relation to the time duration of each successive, applied ignition signal so that the current-limit duty cycle remains a constant percent of the firing cycle time period. Thus sufficient sparking potential is provided even though the engine may be accelerating at a maximum specified rate.

BRIEF DESCRIPTION OF THE DRAWINGS

FIG. 1 is a partial block and schematic diagram illustrating a solid-state ignition system of one embodiment of the invention;

FIG. 2 illustrates waveforms which are useful in understanding the operation of the embodiment of the invention;

DETAILED DESCRIPTION OF THE PREFERRED EMBODIMENTS

Figure 3:
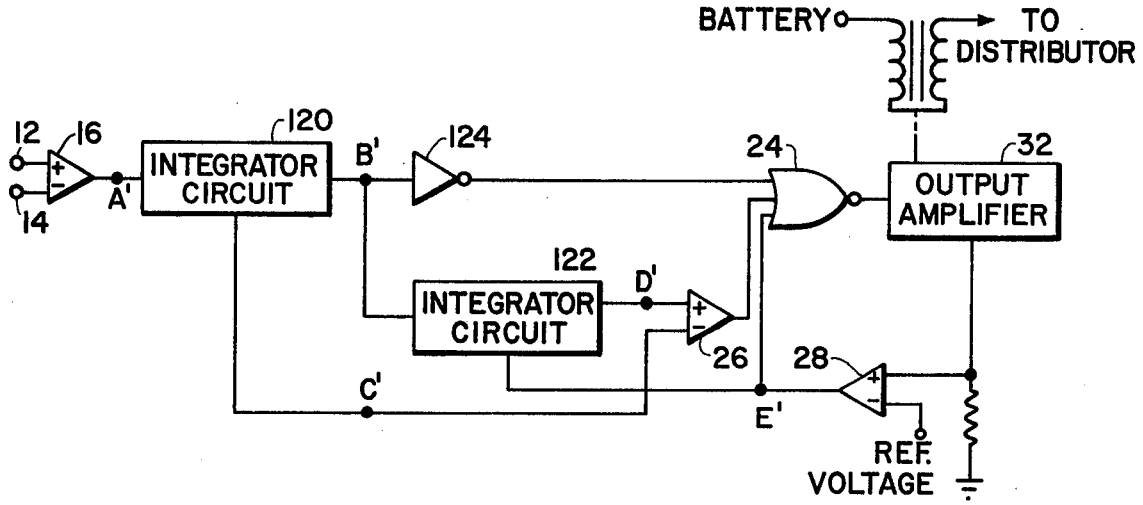
FIG. 3 is a partial block and schematic diagram illustrating a solid state ignition system of another embodiment of the invention.

Referring to FIG. 1, there is illustrated in block diagram form solid-state ignition system 10 which is to be included in an internal combustion engine. Timing signals having generally a sinusoidal shape, with positive and negative portions, are produced in timed relationship with the engine in a well known manner. These timing signals are differentially applied to input terminals 12 and 14, respectively, of differential comparator 16. The output of comparator 16 is applied to integrator circuit 18 the output of which is coupled to the inputs of integrator 20, integrator 22, and one input of NOR gate 24. The respective outputs of integrators 20 and 22 are applied to the input of comparator 26 which, as will be explained hereinafter, provides a control signal at the output thereof when the magnitude of the output signal from integrator 20 is of a predetermined relationship with the output of integrator 22. The output of comparator 26 is connected to a second input of NOR gate 24. A third input to NOR gate 24 is provided from the output of comparator 28 which is also coupled to an input of integrator 22 through conductor 30. The output of NOR gate 24 is coupled to an output amplifier transistor stage 32 which is serially connected between ignition coil 36 and current sensing resistor 38 the other terminal of which is connected to a ground reference terminal. A conventional storage battery (not shown) is coupled in a known manner to one terminal of primary winding 40 of ignition coil 36 with the other terminal of the primary winding being coupled to the output of amplifier stage 32. The secondary winding 42 of ignition coil 36 is coupled to the distributor of the internal combustion engine, as is well known in the art, for providing spark potential to the spark plugs of the internal combustion engine in timed relationship with the cycling of the engine.

In general, integrator circuits 18, 20 and 22 shown in block diagram form in FIG. 1 comprise an integrating capacitor (not shown), and solid-state circuitry suitable for charging and discharging the integrating capacitor at particular ramp rates to provide output signals of a predetermined wave shape as will be hereinafter described. Therefore, because many different integrating circuits may be used by those skilled in the art, the aforementioned integrator circuits will not be specifically described.

For illustration purposes, it is assumed that the internal combustion engine is operating in a steady-state condition or at a constant RPM so that the period of the engine firing cycle is constant. Thus, the generally sinusoidal timing signals produced in timed relationship with the engine will have a constant time period illustrated as time, $T_0$–$T_5$ in FIG. 2. This cycle is not a complete cycle of the rotor of the distributor but represents the cycle required to produce each individual spark in the firing sequence of the operation of the engine. In response to each timing signal, differentiator-comparator 16 produces square wave pulse train 50 (FIG. 2A) having a substantially 50 percent duty cycle. Waveform portions 52 and 54 are generated during the positive and negative half cycles, respectively, of each applied timing signal.

In response to the square wave pulse train being applied to input terminal A of integrator circuit 18, an integrating capacitor (not shown) is discharged at a first controlled rate from an established voltage level, which is dependent on the previous firing cycle period, during the first quarter period $T_0$–$T_1$. The capacitor is then charged at a second controlled rate between time $T_2$–$T_5$. Integrator circuit 18, for example, may include a comparator and gating circuit whereby an output pulse is produced only while the aforementioned integrating capacitor is being discharged so that a monopulse signal (FIG. 2B) is developed at an output terminal. By establishing the rates at which the capacitor is charged and discharged, to be of the correct ratio to one another, pulse 58 can be caused to occur during the first quarter cycle of the time period for each generated ignition signal.

The output of integrator circuit 18 is applied to one input of NOR gate 24 and positively inhibits any output therefrom during time period $T_0$–$T_1$ such that output amplifier stage 32 is prevented from being rendered conductive. Therefore, energizing current cannot be produced through primary winding 40 during the first quarter portion of the firing cycle. This is to ensure that any noise signal produced at the end of the previous firing period does not energize the ignition coil. Simultaneously, the output pulse of integrator 18 is applied to the inputs of integrators circuits 20 and 22.

Integrator circuit 20, which includes an integrating capacitor, produces a reference signal at the output thereof in response to the application of the output from integrator 18. It is to be understood, that during time interval $T_0$–$T_1$ with the application of pulse 58, the aforementioned capacitor is caused to be charged at a first predetermined rate such that output portion 62 of waveform 64 (FIG. 2C) ramps upward. During the remainder of the firing cycle ($T_1$–$T_5$) the capacitor is discharged at a different rate such that the output ramps downward, portion 64. In a manner well known in the art, if the capacitor is charged during the first quarter of the firing cycle at three times the rate that it is discharged, and if the slope of portion 64 of waveform 60 is equal to $-1$, the output pulse produced during each firing cycle will be initiated from ground potential and will reach a predetermined magnitude at time $T_1$. The final value of the magnitude of the reference pulse will therefore be at ground potential at the end of the firing cycle, time $T_5$.

Referring to waveform 68, (FIG. 2D) integrator circuit 22 produces a variable threshold voltage at the output thereof. In the steady-state condition, the magnitude of the threshold voltage is held constant and is illustrated as $V_{TH1}$. In reponse to the applied quarter cycle pulse from integrator circuit 18, the voltage across an internal capacitor (not shown) of integrator circuit 22 ramps up to the threshold voltage from a previously established potential, $V_{Ref}$, until time $T_1$. The potential illustrated as $V_{ref}$ is dependent on the time period of the previous firing cycle, being constant only during a steady state condition. The output from integrator circuit 22 will remain constant at $V_{TH1}$ until time $T_4$ at which time the capacitor is discharged, as will be explained, at a different rate than it is charged and reaches the potential, $V_{ref}$, at time $T_5$.

The outputs from integrator circuits 20 and 22 are compared by comparator 26. When the magnitude of the output pulse from integrator circuit 20 is greater than the threshold potential appearing at the output of integrator circuit 22, the output from comparator 26 is a logic 1 such that NOR gate 24 inhibits output amplifier 32 from being rendered conductive. Thus, between the time interval $T_0$ to $T_3$, no energizing current is produced. However, at time $T_3$, when the magnitude of the output from integrator circuit 20 becomes substantially equal to or less than the magnitude of the threshold potential from integrator circuit 22, the output of comparator 26 changes sense. Therefore, all of the inputs to NOR gate 24 are at a logic 0, and NOR gate 24 is enabled to thereby render output amplifier 32 conductive. In response thereto, energization current begins to flow through primary winding 40 (portion 69 of waveform 70, FIG. 2E) through the amplifier and sensing resistor 38 to ground. The output pulse from integrator 20 is caused to be returned to ground potential (waveform portion 72) such that integrator circuit 20 is returned to its initial state. This assures that at the beginning of the next firing cycle, time $T_5$, the output from this integrator will rise from ground potential.

Between time $T_3$–$T_4$, with amplifier stage 32 being in a saturated condition, the energizing current produced therethrough rises at a rate most nearly determined by the L/R time constant of primary winding 40, portion 69 of waveform 70. In response to the magnitude of the energizing current through primary winding reaching a predetermined value, the current feedback loop comprising sensing resistor 38 and comparator 28 is rendered operative to produce an increasing inhibiting signal to NOR gate 24. As NOR gate 24 is inhibited, the drive signal to amplifier stage 32 is reduced such that current limiting is reached at time $T_4$ and no further increase in energizing current occurs between time $T_4$–$T_5$ as illustrated by portion 74 of waveform 70. Simultaneously, the output signal from comparator 28 is applied to the other input to integrator circuit 22 such that the output thereof is reduced at the same rate as portion 64 of the output pulse waveform 60 of integrator circuit 20 (portion 76 of waveform 68). At time $T_5$, the beginning of the next firing time period, in response to the next timing signal being applied to the input of comparator 16, another 25 percent duty cycle pulse will be generated by integrator circuit 18. NOR gate 24 is then positively inhibited and amplifier stage 32 is rendered nonconductive. Subsequently, energization current through ignition coil 36 is abruptly ceased (portion 78 of waveform 70) and the magnetic field collapses thereacross which produces a spark potential across secondary winding 42 and ignition in the engine, as is understood.

In a steady state condition, i.e., the engine is running at constant speed, each cylinder will be ignited in timed relationship to the engine. Moreover, by selecting the rate of increase of portion 66 of the threshold voltage output pulse from integrator circuit 22 to be of a predetermined ratio to the rate of decrease of portion 76, the current-limit duty cycle (portion 74) will be a fixed percentage of the total firing cycle, time interval $T_0$–$T_5$. For example, if the slope of waveform 68 between time $T_0$–$T_1$ (25 percent of the time period $T_0$–$T_5$) is caused to be constant, and is four tenths of the value of the slope between time $T_4$–$T_5$, the current-limiting duty cycle is regulated to be substantially a fixed 10 percent of the total firing cycle. Therefore, sufficient spark potential will be developed at time $T_5$ to cause ignition in the engine. Simultaneously to the collapse of the field across primary winding 40 and the beginning of the next applied timing signal, the aforedescribed output pulses are again initiated by the solid-state ignition system 10.

Thus, what has been described above, is an electronic circuit for a solid-state ignition system for providing sufficient spark potential in timed relationship to the engine. It was assumed that the engine was running at a constant speed such that the magnitude of the threshold voltage produced at the output of integrator circuit 22 would reach a constant value between each firing cycle. In response to the comparison of the relative magnitudes of the threshold voltage and a reference signal pulse, energization current is generated at a predetermined time during the firing cycle such that a constant dwell time (energizing current on time to off time) is provided to ensure sufficient spark potential to be present. The current limit duty cycle is caused to be constant at any engine RPM, as long as the engine RPM is constant.

However, during conditions other than steady-state, i.e., when the engine is accelerating, it is important to ensure adequate spark potential be maintained. If a specified current-limiting time period can be obtained prior to initiation of an ignition spark, sufficient spark potential will be obtained for the internal combustion engine for a specified acceleration rate.

Still referring to FIG. 2, for illustration purposes, it is assumed that the engine speed is accelerating during time interval $T_5$–$T_9$ and reaches a new steady-state condition thereafter. Therefore, in response to initiation of the quarter cycle pulse at time $T_5$, the output pulse from integrator circuit 20 ramps up at a constant slope of three (as previously discussed), until time $T_6$, when the pulse begins ramping downward with a constant slope of one, due to the termination of quarter cycle pulse 58'. Simultaneously, the output pulse from integrator circuit 22 is charging to the same magnitude of threshold voltage, $V_{TH1}$ of the previous cycle. At time $T_7$, the magnitude of the pulse from integrator circuit 20 becomes equal to the threshold voltage and energizing current is initiated as previously explained. Current-limiting occurs at time, $T_8$, and the output pulse from integrator 22 once more begins to discharge with the slope of $-1$. Because the engine speed is accelerating, the firing cycle time period, $T_5$–$T_9$ is foreshortened such that the output pulse from integrator circuit 22 is not fully discharged to the initial voltage, $V_{ref}$, when the next quarter cycle pulse 58'' is applied, the difference being illustrated as the voltage $V_1$. Therefore at time, $T_9$, the output pulse from integrator circuit 22 begins ramping upwards from the potential, $V'_{ref}$. The output of integrator circuit 22 will increase at the same constant rate until time $T_{10}$, to a higher threshold voltage level, $V_{TH2}$. With the threshold voltage being at a greater magnitude, threshold will occur sooner in the next firing cycle, at time $T_{11}$, initiating energizing current through the primary winding of the ignition coil. Current-limiting occurs at time $T_{12}$ which initiates discharging of the output voltage from integrator circuit 22 in the normal manner. As the energizing current has been initiated sooner in the firing cycle, current-limiting will occur longer which, therefore, allows the output of integrator circuit 22 to discharge to a lower voltage potential, illustrated as $V''_{ref}$. Thus, during the time interval $T_9$–$T_{13}$, although a new steady-state condition has been reached, the dwell time will be greater. However, in response to the next application of the quarter cycle pulse the output from integrator circuit 22 is charged up to the threshold potential $V_{TH3}$ and the aforedescribed cycle is repeated between times $T_{13}$ and $T_{17}$. Thereafter, as long as the engine speed remains constant at the new steady-state condition, the magnitude of the threshold voltage in subsequent firing cycles will be $V_{TH3}$. Thus, the current limit duty period is once again a constant and is substantially 10 percent of the total firing cycle.

It can be shown that the magnitude of the variable threshold signal is linearly related to the total firing cycle period and to the current charge time through the primary winding of the ignition coil. Therefore, as described above the feedback loop to integrator circuit 22 linearly varies the magnitude of the threshold voltage at the output of the integrator circuit such that the current-limit duty cycle of the ignition coil is a fixed percent of the firing cycle. Thus, with the current-limit time being fixed, sufficient spark potential is developed across the ignition coil to ensure that a spark will occur to operate the engine for a specified acceleration rate of the engine RPM. Moreover, by controlling the rates of charge and discharge of the integrating capacitor of integrator circuit 22, which in the above described circuit might be a ratio of 1:0.4, the current-limit duty cycle is approximately 10 percent of the firing cycle. Thus, even though the charge time through the coil may vary, due to different coils being used or to varying battery voltages, a value of 10 percent is sufficient to ensure a spark during maximum specified acceleration rates of engine RPM.

Figure 4:
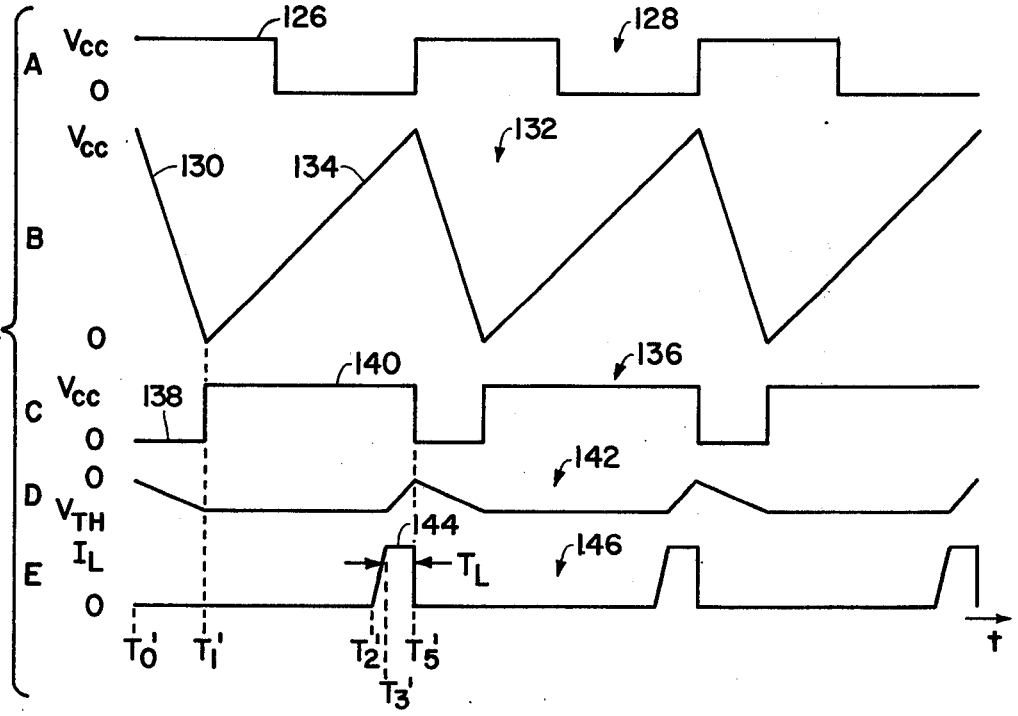
FIG. 4 illustrates waveforms useful in understanding the operation of the embodiment of FIG. 4.

Referring to FIGS. 3 and 4, the same reference numbers are used for components corresponding to like components of FIG. 1. The structure of the circuit of FIG. 3 is very similar to that of FIG. 2 except that essentially (as will be discussed hereinafter) the functions of integrator circuit 18 and 20 have been combined and are provided by integrator circuit 120.

In response to each alternating current timing signal applied to input terminals 12 and 14 of comparator 16, a 50 percent duty cycle output rectangular pulse is produced at the output thereof in a like manner as discussed above. Therefore, at time $T_0'$, on the positive transition of the applied timing signal, the output of comparator 16 which is applied to input of integrator circuit 120 at terminal A', goes positive, portion 126 of waveform 128, causing the output of integrator circuit 120 at terminal C' to decrease at a constant predetermined rate. During steady state operating conditions, the output of integrator circuit 120 at the terminal C' can be caused to reach ground potential during the first quarter cycle of the applied ignition signal such that at time $T_1'$, the voltage thereat is at zero potential. In response to portion 130 becoming zero, integrator circuit 120 is internally reset such that at time $T_1'$ the output begins rising at a different predetermined constant rate, portion 134 of waveform 132. The voltage at output terminal C' continues to rise for the remaining 75 percent of the applied pulse to the input of integrator circuit 120, between time $T_1'$ and $T_5'$. Simultaneously, at output terminal B' of integrator circuit 120, an output signal is produced thereat, waveform 136, rectangular in shape and which has a first portion 138 corresponding to the decrease of the output at C' and a second portion 140 related to the time that the output at C' is rising. Thus, integrator circuit 120 produces both a phase-locked 75 percent duty-cycle signal (waveform 136) and an output voltage (waveform 132) linearly related to time before the end of the cycle.

The output of integrator circuit 120 which is applied at terminal B' is supplied to the input of integrator circuit 122 and to inverter circuit 124. Therefore, during the first quarter cycle of the input signal, waveform portion 138 of waveform 136, NOR gate 24 is positively inhibited thereby rendering output amplifier 32 nonconductive which is identical to the system of the embodiment of FIG. 1. In response to the input signal applied thereto, integrator circuit 122 produces a variable threshold voltage at output terminal D' which decreases during the first quarter cycle to a variable voltage potential which during steady state operation, the magnitude thereof remaining constant, similar to the above described ignition system. The outputs of integrator circuit 120, at output terminal C', and integrator circuit 122, at D', are compared by comparator 26 which produces an output signal to one input of NOR gate 24 at time $T_2'$ when the magnitude of waveform portion 134 becomes greater than the magnitude of the reference voltage (waveform 142) thereby rendering output amplifier 32 conductive in the same manner as previously discussed. In response to the current conducted through primary winding 40 of ignition coil 36 through amplifier 32 and sensing resistor 38 reaching a predetermined value, the magnitude of voltage produced across sensing resistor 38 causes the output of comparator 28 to changes sense such that between time intervals $T_3'$–$T_5'$ the current through output amplifier 32 is limited to a predetermined value (portion 144 of waveform 146). In response to the next positive transition of the next timing signal, at time $T_5'$, the output at terminal B' once again goes low, which is then inverted for positively inhibiting NOR gate 24 such that output amplifier 32 is abruptly rendered nonconductive causing discharge of the magnetic field across primary winding 40 of ignition coil 46, thereby generating a spark to operate the engine.

Thus, in a steady state condition, the output of amplifier 32 is current-limited for a constant percent of the total firing cycle, time interval $T_L$. Therefore, the current limit time of the ignition system is a fixed percent of the total ignition cycle.

As previously discussed in great detail, if the speed of the engine should either accelerate or decelerate, such that a deviation in current-limited time $T_L$ should occur, the magnitude of the variable threshold voltage will be linearly corrected by the correct amount, thereby returning the current-limited time to a fixed percent of the overall ignition cycle.

What has been described, therefore, are improved solid state ignition systems. The ignition system of FIGS. 1 and 4 provide for linearly varying the dwell time such that it remains a fixed percent of each ignition cycle which is produced in timed relationship with an internal combustion engine. Moreover, a linear feedback control loop is employed in each of the solid state ignition system to linearly vary the dwell time in response to varying ignition cycle time periods and varying energizing current ramp time through the ignition coil. In addition, the aforedescribed solid state ignition system ensures that sufficient spark potential will be provided in timed relationship with the engine to ensure operation thereof.

What is claimed is:

1. An ignition system for an internal combustion engine which is responsive to alternating ignition signals generated in timed relationship with the engine and which includes an amplifier switching circuit for charging and discharging an ignition coil, comprising in combination:

first circuit means responsive to each successive generated ignition signal for producing a monopulse output signal and a reference output signal comprising dual constant slopes, said monopulse signal being produced during a predetermined portion of a half cycle of the ignition signal, the first constant slope portion of said reference output signal being produced simultaneously with said monopulse output signal, the second constant slope portion of said reference output signal being produced during the remainder of the duration of the ignition signal;

second circuit means responsive to said monopulse signal for producing a variable threshold signal;

the amplifier switching circuit being responsive to the magnitude of said second slope portion of said reference signal reaching a predetermined value with respect to said variable threshold signal for charging the ignition coil and being responsive to said monopulse signal to discharge the coil;

feedback means responsive to the current through the amplifier switching circuit reaching a predetermined value for limiting the same thereat and for causing the magnitude of said variable threshold signal to be linearly varied for regulating the current limit duty cycle to be a fixed percent of the ignition signal time period.

2. The ignition system of claim 1 including:

comparator means having first and second input terminals and an output terminal, said first and second input terminals being coupled, respectively to said first and second circuit means;

gating means having first, second and third input terminals and an output terminal, said first input terminal being connected to said first circuit means, said second input terminal being connected to said second circuit means, said third input terminal being connected to said feedback means, said output terminal being connected to the amplifier switching circuit; and said second circuit means comprising an integrator circuit having first and second input terminals and an output terminal, said first input terminal being coupled to said first circuit means, said second input terminal being coupled to said feedback means, said output terminal being connected to said second input terminal of said comparator means.

3. The ignition system of claim 2 wherein said first circuit means includes:

additional comparator means having first, second input and output terminals said first and second input terminals being adapted to receive the alternating ignition signals;

a first integrator circuit having an input terminal and an output terminal, said input terminal being coupled to said output terminal of said additional comparator means, said output terminal being coupled to said first input terminal of said gating means and to said first input terminal of said integrator circuit of said second circuit means, said monopulse output signal being produced at said output terminal of said first integrator circuit; and a second integrator circuit having input and output terminals, said input terminal being coupled to said output terminal of said first integrator circuit, said output terminal being coupled to said first input terminal of said comparator means, said reference signal being produced at said output terminal.

4. An internal combustion engine solid-state ignition system which is responsive to alternating timing signals generated in timed relationship with the engine for charging and discharging an ignition coil to produced spark to operate the engine, comprising in combination:

first circuit means responsive to each successive generated timing signal applied thereto for producing a monopulse signal and a reference signal at respective outputs thereof, said monopulse signal being produced during a predetermined half cycle of each successive ignition signal for a predetermined duration thereof, said reference signal having first and second portions, said first portion being indicative of said predetermined duration when said monopulse is being produced, said second portion being indicative of the remainder of the duration of each successive applied ignition signal;

amplifier means responsive to a control signal applied thereto for conducting energizing current through the ignition coil to charge the same, said amplifier means being rendered nonconductive when said control signal is inhibited such that the ignition coil is discharged to produce the spark to operate the engine;

feedback means responsive to said energizing current reaching a predetermined magnitude for producing a feedback control signal at an output thereof;

second circuit means operatively coupled to said first circuit means and said feedback means and being responsive to said monopulse signal and said feedback control signal for producing a variable threshold signal at an output thereof, the magnitude of said variable threshold signal being linearly related to the time duration of each successive timing signal and the time duration for charging the ignition coil;

comparator-gating means responsive to said reference signal and said variable threshold signal applied thereto for producing said control signal when the magnitude of said second portion of said reference signal reaches a predetermined value with respect to the magnitude of said variable threshold signal;

said first circuit means including;

a. a first integrator circuit having an input and an output terminal, said first integrator circuit being responsive to the positive transition of each generated ignition signal such that said monopulse signal is produced at said output terminal, said input terminal being coupled to the input of the solid state ignition circuit; and b. a second integrator circuit having an input and an output terminal, said second integrator circuit being responsive to said monopulse signal from said first integrator circuit being applied at said input terminal for generating said reference signal at said output terminal.

5. The ignition circuit of claim 1 wherein said comparator-gating means includes:

a comparator circuit having an inverting and noninverting terminals and an output terminal, said inverting terminal being coupled to said output of said second circuit means, said noninverting terminal being coupled to said output of said second integrator circuit; and gating means having first, second, third inputs and an output, said first input being coupled to said output of said comparator circuit, said second input being coupled to said output of said first integrator circuit, said third input being coupled to said feedback means, said output being coupled to said amplifier means.

6. The ignition system of claim 5 including comparator means for producing a rectangular output pulse at an output thereof in response to the ignition signal being applied thereto, said output being coupled to said input terminal of said first integrator circuit.

7. An internal combustion engine solid-state ignition system which is responsive to alternating timing signals generated in timed relationship with the engine for charging and discharging an ignition coil to produce spark to operate the engine, comprising in combination:

first circuit means responsive to each successive generated timing signal applied thereto for producing a monopulse signal and a reference signal at respective outputs thereof, said monopulse signal being produced during a predetermined half cycle of each successive ignition signal for a predetermined duration thereof, said reference signal having first and second portions, said first portion being indicative of said predetermined duration when said monopulse is being produced, said second portion being indicative of the remainder of the duration of each successive applied ignition signal;

amplifier means responsive to a control signal applied thereto for conducting energizing current through the ignition coil to charge the same, said amplifier means being rendered nonconductive when said control signal is inhibited such that the ignition coil is discharged to produce the spark to operate the engine;

feedback means responsive to said energizing current reaching a predetermined magnitude for producing a feedback control signal at an output thereof;

second circuit means operatively coupled to said first circuit means and said feedback means and being responsive to said monopulse signal and said feedback control signal for producing a variable threshold signal at an output thereof, the magnitude of said variable threshold signal being linearly related to the time duration of each successive timing signal and the time duration for charging the ignition coil;

comparator-gating means responsive to said reference signal and said variable threshold signal applied thereto for producing said control signal when the magnitude of said second portion of said reference signal reaches a predetermined value with respect to the magnitude of said variable threshold signal;

said first circuit means including a first integrator circuit having an input, first and second outputs, said integrator circuit being responsive to the positive transition of each ignition signal to produced said first portion of said reference signal and said monopulse signal, said integrator circuit being further responsive to said first portion of said reference signal reaching a predetermined magnitude to produce said second portion of said reference signal, said monopulse signal and said reference signal being applied respectively to said first and second output terminals of said first integrator circuit; and said second circuit means comprising a second integrator circuit having first, and second input terminals and an output terminal, said first input terminal being coupled to said first output terminal of said first integrator circuit, said second input terminal being coupled to said output of said feedback means, and said output terminal being coupled to said comparator gating means.

* * * * *